US010321518B2

(12) United States Patent
Mine et al.

(10) Patent No.: US 10,321,518 B2
(45) Date of Patent: Jun. 11, 2019

(54) HEATING DEVICE FOR HEATING RECORDING MATERIAL, AND IMAGE FORMING APPARATUS HAVING THE SAME

(71) Applicant: CANON KABUSHIKI KAISHA, Tokyo (JP)

(72) Inventors: Ryuta Mine, Toride (JP); Toshiyuki Abe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 1295 days.

(21) Appl. No.: 13/927,692

(22) Filed: Jun. 26, 2013

(65) Prior Publication Data

US 2014/0027441 A1 Jan. 30, 2014

(30) Foreign Application Priority Data

Jul. 26, 2012 (JP) ..... 2012-165866

(51) Int. Cl.
*H05B 3/02* (2006.01)
*H05B 1/02* (2006.01)
*H05B 3/26* (2006.01)

(52) U.S. Cl.
CPC ..... *H05B 3/02* (2013.01); *H05B 1/0241* (2013.01); *H05B 3/265* (2013.01); *H05B 2203/004* (2013.01); *H05B 2203/005* (2013.01); *H05B 2203/013* (2013.01); *H05B 2203/037* (2013.01)

(58) Field of Classification Search
CPC ..... H05B 3/02; H05B 1/0241; H05B 3/265; H05B 2203/004; H05B 2203/005; H05B 2203/013; H05B 2203/037
USPC ..... 219/538
See application file for complete search history.

(56) References Cited

U.S. PATENT DOCUMENTS 5,421,896 A * 6/1995 Igarashi ..... C23C 14/26 219/538
6,323,460 B1 * 11/2001 Ohtsuka ..... G03G 15/2064 219/121.69
6,734,397 B2 * 5/2004 Kato ..... H05B 3/0095 219/216

(Continued)

FOREIGN PATENT DOCUMENTS

JP 10-177319 A 6/1998
JP 10177319 A * 6/1998

(Continued)

*Primary Examiner* — Dana Ross
*Assistant Examiner* — Kuangyue Chen
(74) *Attorney, Agent, or Firm* — Rossi, Kimms & McDowell LLP

(57) ABSTRACT

A heating device capable of suppressing electrically conductive parts that electrically connect power supply electrodes and heating resistors from generating heat. The heating device has heating resistors disposed in a longitudinal direction of an elongated base plate and connected through electrically conductive parts to power supply electrodes disposed on one longitudinal end portion of the base plate and supplied with electric power from the power supply electrodes. The electrically conductive parts are formed such that electrically conductive parts that can provide larger amounts of power supply each have a larger cross-sectional area perpendicular to a power supply direction.

11 Claims, 6 Drawing Sheets

(56) References Cited

U.S. PATENT DOCUMENTS 7,193,181 B2 * 3/2007 Makihira ..... G03G 15/2042
219/216

FOREIGN PATENT DOCUMENTS

JP 2002-296955 A 10/2002
JP 2008139668 A * 6/2008

* cited by examiner

HEATING DEVICE FOR HEATING RECORDING MATERIAL, AND IMAGE FORMING APPARATUS HAVING THE SAME

BACKGROUND OF THE INVENTION

Field of the Invention

The present invention relates to a heating device that heats a recording material formed with an unfixed image to fix the image to the recording material, and an image forming apparatus having the heating device.

Description of the Related Art

In an electrophotographic copying machine or printer, there is used a heating device that thermally fixes an unfixed toner image formed on a recording material (such as a transfer sheet or a photosensitive sheet) to the recording material. For example, an on-demand film-heating-type device has been known (see, for example, Japanese Laid-open Patent Publication No. 2002-296955).

In the film-heating-type heating device, a ceramic heater or other heating member is used. The ceramic heater includes a ceramic base plate (e.g. of alumina or aluminum nitride) which is electrically resistant, heat-resistant, and excellent in thermal conductivity. The ceramic heater further includes heating resistors (e.g. of silver palladium) which are pattern-shaped on the base plate e.g. by printing or baking and which generate heat when supplied with electric power, power supply electrodes which are pattern-shaped e.g. by printing or baking, and a conductor pattern which is low in resistance and which connects the power supply electrodes and the heating resistors to one another. The ceramic heater, which is configured as described above to generate heat when the heating resistors are supplied with electric power through the power supply electrodes and the conductor pattern, is low in heat capacity as a whole and therefore high in temperature rise speed.

When recording materials that are small in size in a longitudinal direction of the heating member (i.e., small in widthwise size of recording materials) are continuously thermally fixed in the heating device whose heating member is formed by the ceramic heater which is small in heat capacity, heating member temperature tends to more easily rise at longitudinally opposite end portions of the heating member where recording materials do not pass than at a longitudinal central portion thereof where recording materials pass. In that case, due to the presence of a temperature difference in the longitudinal direction of the heating member, gloss unevenness tends to occur in fixed images. To avoid this, print speed must be decreased or temperature difference in the longitudinal direction of the heating member must be reduced.

Thus, there have been proposed heating devices each having a heating member provided with a plurality of heating resistors and a plurality of temperature detecting elements for detecting temperatures of the heating member at plural longitudinal positions and each configured to control power supply to the heating resistors based on the detected temperatures, thereby preventing gloss unevenness from occurring in fixed images due to a temperature difference in the longitudinal direction of the heating member.

As such a heating device, there is for example a fixing device that has a heating member formed by heating resistors disposed and configured to generate a large amount of heat at parts of the heating member where recording materials of any size pass and by heating resistors disposed and configured to generate a large amount of heat at parts of the heating member where only recording materials which are large in size pass (see, Japanese Laid-open Patent Publication No. 10-177319).

This fixing device controls power supply to the heating resistors based on a temperature detection result, thereby reducing a temperature rise at parts of the heating member where recording materials do not pass and thereby controlling temperatures at parts of the heating member where recording materials pass to predetermined temperatures. However, a conductor pattern (hereinafter, referred to as the electrically conductive parts or the conductive parts) that connects the heating resistors and the power supply electrodes sometimes generates heat, which can cause a problem.

To improve the reliability of connection between component parts formed on the base plate of the ceramic heater and the power supply electrodes, a relative large area is provided for installation of the power supply electrodes. Even in a small-sized heating device having a base plate which is compact in size, a large area is ensured to install the power supply electrodes. Thus, a space occupied by the conductive parts that connect the heating resistors and the power supply electrodes is naturally constrained in the heating device where a large area is provided for installation of the power supply electrodes.

It should be noted that the electrically conductive parts each have a resistance value although it is small. More specifically, the resistance value of each conductive part is inversely proportional to a cross-sectional area of the conductive part, and hence increases with decrease of the cross-sectional area of the conductive part. When electric power is supplied to the heating resistors, there occur power losses each represented by the product of current value and resistance value of the conductive part, and heat is generated.

In a heating device configured to control power supply to a plurality of heating resistors, power supply electrodes are provided for respective ones of the heating resistors, and therefore electrically conductive parts are installed in a more restrained space. In particular, a space for conductive parts, which are connected to power supply electrodes disposed remoter from the heating resistors, is more restrained. This requires the electrically conductive parts to be thinned, and much heat tends to generate.

When heat is generated by the electrically conductive parts that connect the heating resistors and the power supply electrodes, temperatures of the power supply electrodes rise and a temperature of a power supply connector connected to the power supply electrodes also rises. As a result, metallic parts such as copper alloy parts of the connector cannot ensure contact pressures that depend on thermal stress characteristics thereof, and the reliability of the connector can be impaired. On the other hand, in a case where metallic parts of the connector are formed by e.g. copper-titanium alloys to ensure the contact pressures, the reliability of the connector can be ensured, but a problem of increased costs is caused.

SUMMARY OF THE INVENTION

The present invention provides a heating device capable of suppressing electrically conductive parts that electrically connect power supply electrodes and heating resistors from generating heat, and provides an image forming apparatus having the heating device.

According to one aspect of this invention, there is provided a heating device comprising a base plate, a plurality of heating resistor members disposed in a longitudinal direction of the base plate, a plurality of power supply electrodes disposed on one longitudinal end portion of the base plate and including power supply electrodes configured to independently supply electric power to heating resistor members of said plurality of heating resistor members together with another power supply electrode connected to said plurality of heating resistor members, and a plurality of electrically conductive parts configured to connect the plurality of heating resistor members and the plurality of power supply electrodes to one another, wherein the plurality of electrically conductive parts are formed such that electrically conductive parts of said plurality of electrically conductive parts that are capable of having larger amounts of current flow therethrough have larger cross-sectional areas thereof with respect to a perpendicular direction to the longitudinal direction of said base plate.

With this invention, electrically conductive parts are formed such that electrically conductive parts capable of providing larger amounts of power supply have larger areas of cross section perpendicular to a power supply direction, and therefore power losses in the conductive parts are made uniform to one another, whereby the conductive parts are suppressed from generating heat. As a result, temperature ratings of peripheral members disposed near the conductive parts can be lowered, thereby contributing to improve the reliability of the heating device and to reduce costs.

Further features of the present invention will become apparent from the following description of an exemplary embodiment with reference to the attached drawings.

DESCRIPTION OF THE EMBODIMENTS

The present invention will now be described in detail below with reference to the drawings showing a preferred embodiment thereof.

Figure 1:
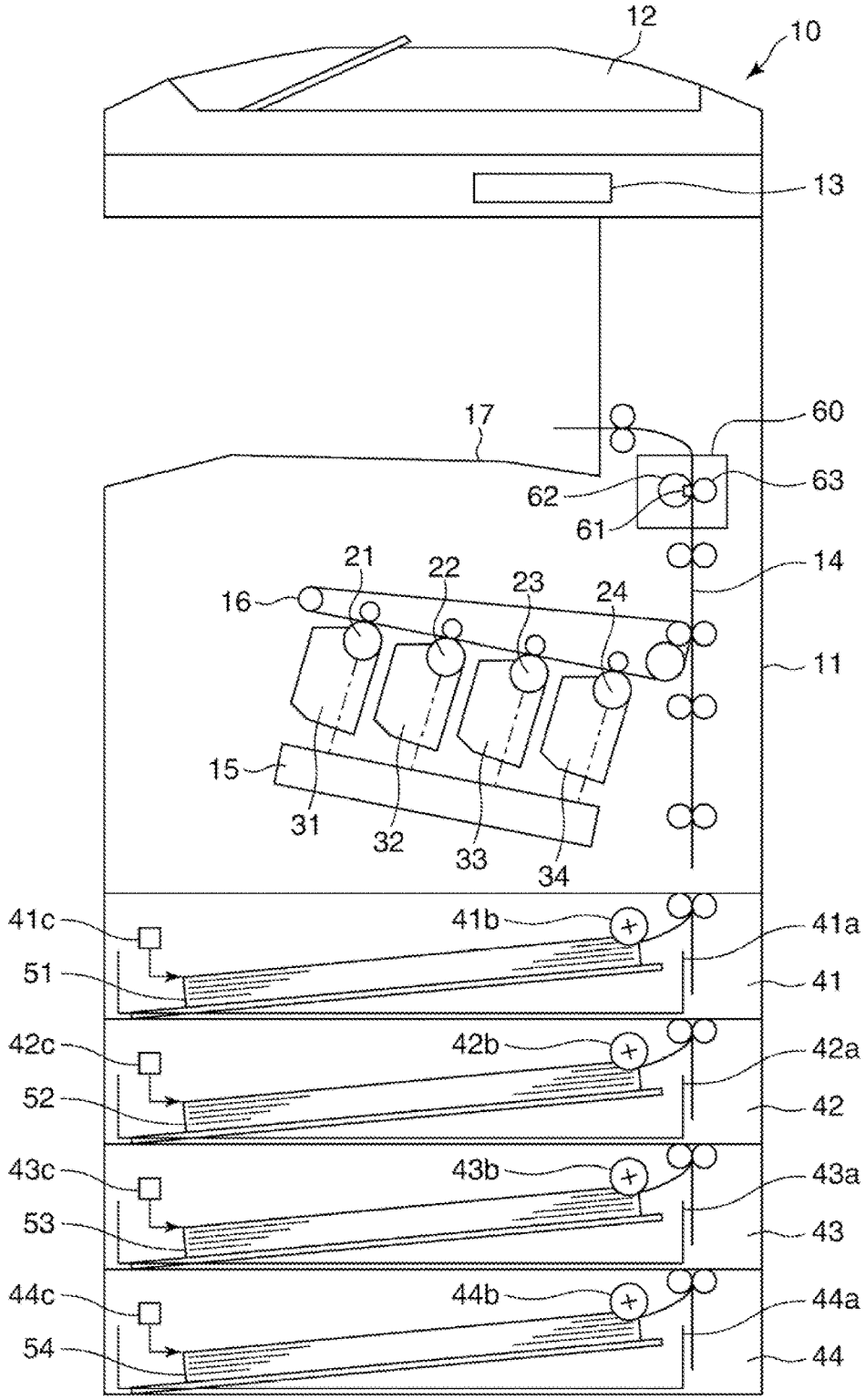
FIG. 1 is a section view schematically showing the construction of an image forming apparatus having a thermal fixing device that serves as a heating device according to one embodiment of this invention.

FIG. 1 schematically shows in section the construction of an image forming apparatus that has a heating device according to one embodiment of this invention. The image forming apparatus is e.g. a digital multifunction peripheral, and includes a heating device such as an on-demand film-heating-type thermal fixing device. It should be noted that the image forming apparatus can be implemented by an electrophotographic apparatus, an electrostatic recording apparatus, or the like, other than the digital multifunction peripheral.

In FIG. 1, reference numeral 10 denotes the digital multifunction peripheral that mainly includes an image forming unit 11 and a document reading unit 12 disposed above the image forming unit 11. The document reading unit 12 has an operation unit 13 operable by a user, and reads an image of a document and transmits an image signal to the image forming unit 11 according to a user's instruction given via the operation unit 13.

The image forming unit 11 is provided with process cartridges 31 to 34 for respective colors that include photosensitive drums 21 to 24, respectively. An optical unit 15 having a polygon mirror, a scanner motor, a laser light source, lens groups, etc. (none of which are shown) is disposed facing the process cartridges 31 to 34. An endless transfer belt 16 is disposed facing and in contact with the photosensitive drums 21 to 24. A conveyance unit 14 having conveyance rollers and a registration roller is disposed in contact with the transfer belt 16. On a downstream side of the conveyance unit 14 in a sheet conveyance direction, a thermal fixing device 60 having a heating member 61, a fixing film 62, and a pressure roller 63 is disposed. On a downstream side of the thermal fixing device 60 in the sheet conveyance direction, an upper part of the image forming unit 11 constitutes a sheet discharge tray 17.

Sheet feed units 41 to 44 are disposed below the optical unit 15. The sheet feed units 41 to 44 have sheet feed cassettes 41*a* to 44*a* in which transfer sheet bundles 51 to 54 (recording materials) are stored. The sheet feed cassettes 41*a* to 44*a* are provided with pickup rollers 41*b* to 44*b*, which are disposed in press contact with separation pads (not shown) and which cooperate with the separation pads to separate and feed transfer sheets one by one from the sheet feed cassettes, and also provided with sheet size sensors 41*c* to 44*c* that detect sheet sizes of the transfer sheet bundles 51 to 54, respectively.

When receiving an image signal from the document reading unit 12, the image forming unit 11 irradiates laser light on the photosensitive drums 21 to 24 for respective colors to thereby form electrostatic latent images on surfaces of the photosensitive drums, and develops the latent images to form toner images.

In synchronism with the formation of the toner images, a transfer sheet is fed from one of the sheet feed units 41 to 44 (e.g., the sheet feed unit 41) through the conveyance unit 14. The toner images formed on the photosensitive drums 21 to 24 are transferred to the transfer belt 16 and further transferred from the transfer belt 16 to the transfer sheet. The transfer sheet (denoted by reference numeral 110 in FIG. 2) formed with the toner images is conveyed to the thermal fixing device 60 in which the transfer sheet 110 is applied with heat and pressure, whereby the toner images are fixed thereto. The transfer sheet 110 fixed with the toner images is discharged to the sheet discharge tray 17.

Figure 2:
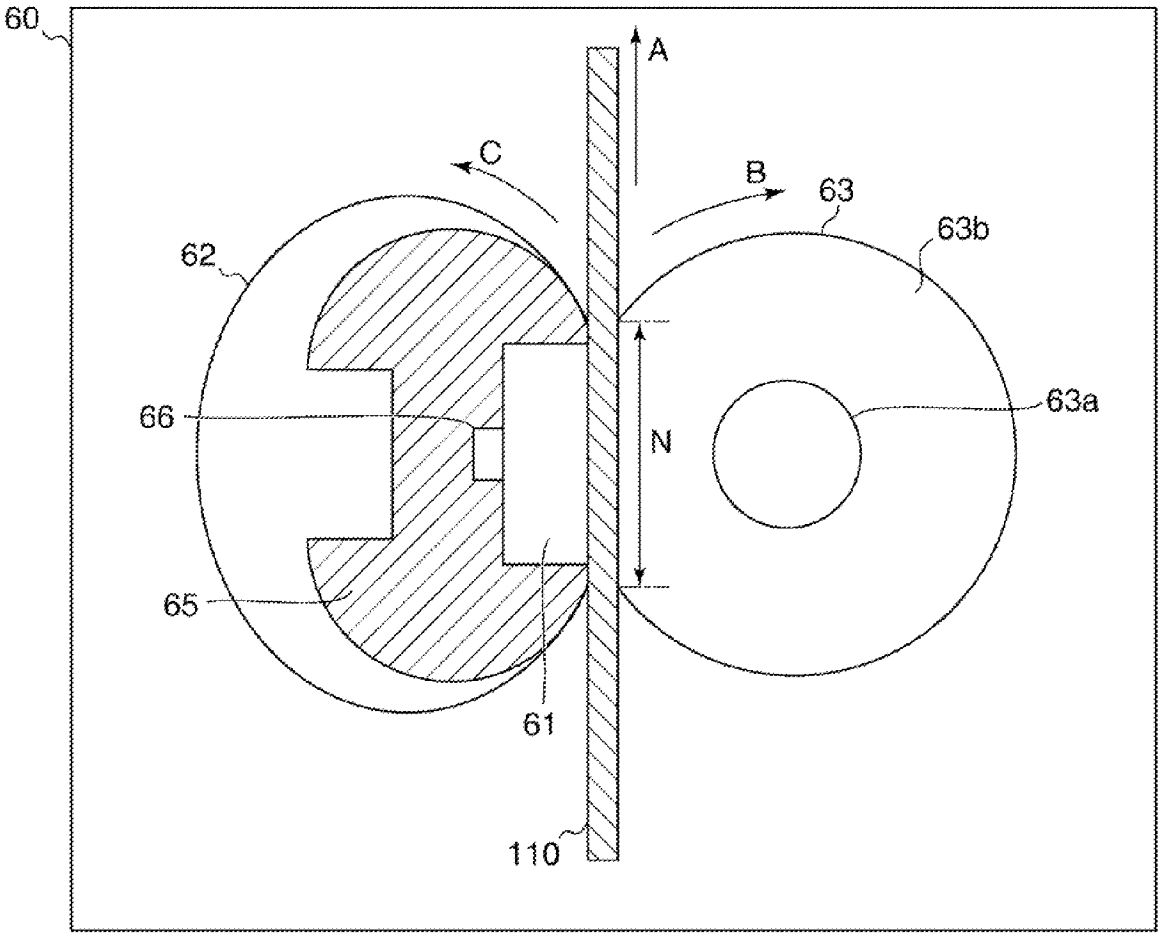
FIG. 2 is a section view schematically showing the construction of the thermal fixing device.

FIG. 2 schematically shows in section the construction of the thermal fixing device 60. In FIG. 2, arrow A indicates a direction to which the transfer sheet 110 is conveyed.

As described above, the thermal fixing device 60 includes the heating member 61, fixing film 62, and pressure roller 63. The heating member 61 is an elongated member that extends longitudinally in a direction transverse to a conveyance path for the transfer sheet 110 (i.e. in a direction perpendicular to the drawing paper of FIG. 2), and that is surrounded by the fixing film 62. The pressure roller 63 is disposed facing the fixing film 62.

The thermal fixing device 60 further includes a rigid stay 65 and thermistors 66, 67. The rigid stay 65 is an elongated heat-resistant and heat-insulating member that extends longitudinally in the direction transverse to the conveyance path for the transfer sheet 110. The rigid stay 65 has a surface facing the transfer sheet 110 and formed with a groove in the direction transverse to the conveyance path for the transfer sheet 110. The heating member 61 is fitted into the groove, and fixed and held therein by a heat-resistant adhesive.

The fixing film 62 is obtained by forming a heat-resistant flexible member, e.g., a heat-resistant film member, into a hollow cylindrical shape, and loosely fitted on the rigid stay 65 attached with the heating member 61. The fixing film 62 is comprised of a hollow cylindrical single-layer film having a thickness of about 40 to 100 μm and formed e.g. of PTFE, PFA, or FEP having heat resistance, releasability, high strength, durability, etc. Alternatively, the fixing film 62 may be a multi-layer film having a cylindrical film of polyimide, polyamide, PEEK, PES, PPS, or the like whose outer peripheral surface is coated with PTFE, PFA, FEP, or the like.

The pressure roller 63 is an elastic roller that has a core shaft 63*a* and a heat-resistant elastic cylinder 63*b* made of e.g. silicone rubber and fixedly fitted on the core shaft 63*a* and that is disposed in press contact with the heating member 61. The heating member 61 cooperates with the pressure roller 63 to form a fixing nip N where the fixing film 62 is held between the heating member and the pressure roller.

The pressure roller 63 is driven to rotate at a predetermined circumferential speed in a direction indicated by arrow B. With the rotation of the pressure roller 63, a friction force is generated at the fixing nip N between the pressure roller 63 and the fixing film 62. A rotation force of the pressure roller 63 acts on the fixing film 62. When the transfer sheet 110 is introduced into the fixing nip N, the rotation force of the pressure roller 63 acts on the fixing film 62 via the transfer sheet 110, whereby the fixing film 62 is rotated about the rigid stay 65 in a direction indicated by arrow C, while being in pressure sliding contact with the heating member 61.

The rigid stay 65 has a function of guiding the fixing film 62 that rotates about the rigid stay 65, whereby the fixing film 62 can easily rotate around the rigid stay 65. It should be noted that a small amount of lubricant such as heat-resistant grease can be applied between the heating member 61 and the fixing film 62 to reduce sliding resistance therebetween.

In a state where the rotation of the fixing film 62 caused by the rotation of the pressure roller 63 becomes steady, it is waited that the temperature of the heating member 61 reaches a predetermined temperature, while monitoring the temperature of the heating member 61 by the thermistors 66, 67 (see, FIG. 5 described later) disposed on the heating member 61 to be apart from each other in the longitudinal direction of the heating member.

After the temperature of the heating member 61 is raised to the predetermined temperature, the transfer sheet 110 to which a toner image is to be fixed is introduced to the fixing nip N where the transfer sheet 110 is heated by the heating member 61, while being sandwiched and conveyed between the fixing film 62 and the pressure roller 63. As a result, heat generated by the heating member 61 is efficiently transferred and applied to the transfer sheet 110 via the fixing film 62, and an unfixed toner image formed on the transfer sheet 110 is thermally fixed thereto. Thereafter, the transfer sheet 110 passes through the fixing nip N, and is separated from the fixing film 62 and conveyed in the direction of arrow A.

Figure 3A:
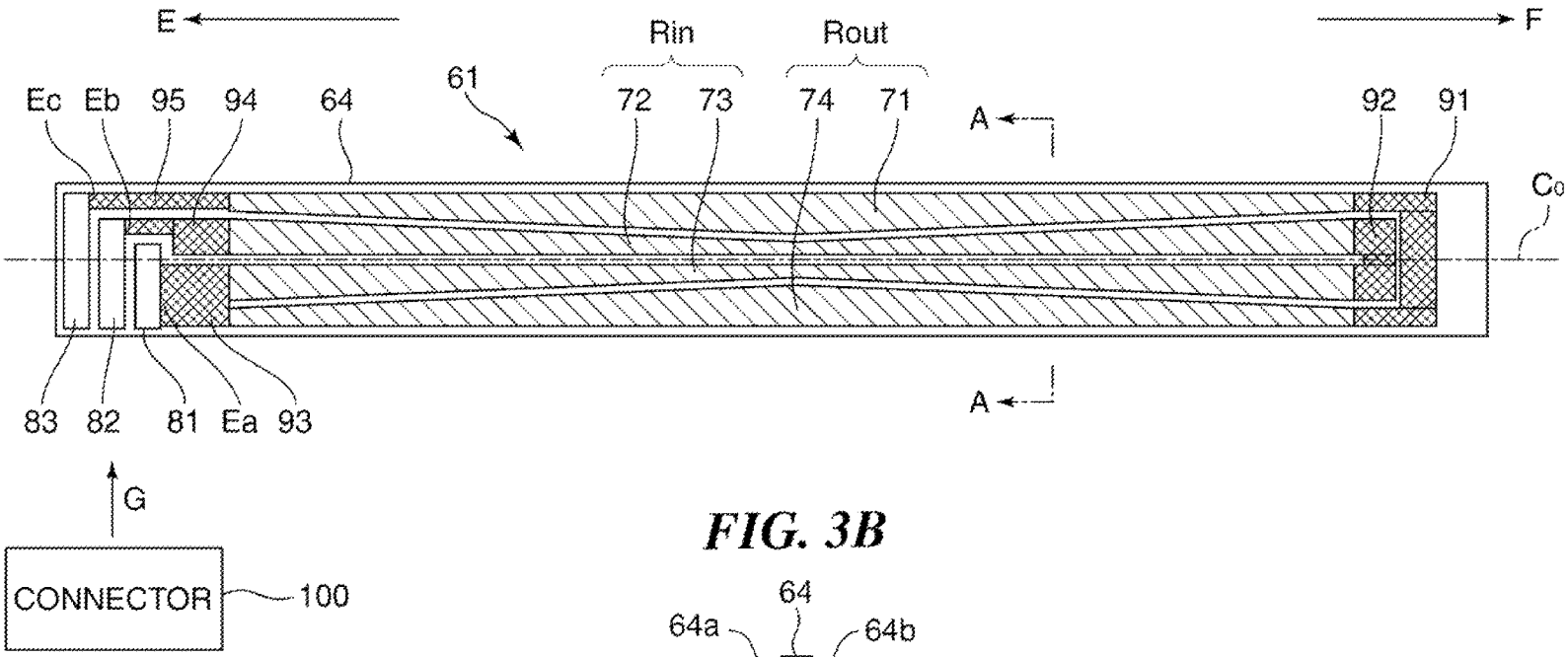
FIG. 3A is a schematic view of a heating member of the thermal fixing device as seen from a side of a pressure roller.
Figure 3B:
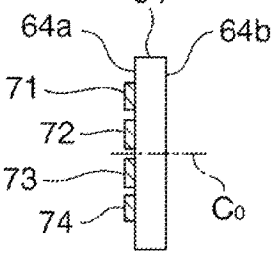
FIG. 3B is a section view taken along line A-A shown in FIG. 3A.

FIG. 3A schematically shows the heating member 61 of the thermal fixing device 60 as seen from the side of the pressure roller, and FIG. 3B is a section view taken along line A-A in FIG. 3A.

As shown in FIGS. 3A and 3B, the heating member 61 has a base plate 64 disposed parallel to a surface of the transfer sheet 110 which is introduced to the thermal fixing device 60. The base plate 64 is formed into an elongated shape that extends laterally in the direction of conveyance of the transfer sheet 110 subjected to thermal fixing. The base plate 64 is disposed such that one longitudinal end portion (hereinafter, referred to as the E-side end portion) thereof is positioned on the front side of the drawing paper of FIG. 2 and another longitudinal end portion (hereinafter, referred to as the F-side end portion) thereof is positioned on the rear side of the drawing paper of FIG. 2.

The base plate 64 is made from a ceramic material such as alumina or aluminum nitride, and has first and second faces 64*a*, 64*b*. On the first face 64*a* of the base plate 64, there are formed by printing and baking a plurality of (e.g., four) heating resistors 71 to 74 and a plurality of (e.g., three) power supply electrodes 81 to 83. The heating resistors 71 to 74 are each formed of silver palladium and each generate heat when supplied with electric power. The power supply electrodes 81 to 83 are provided on the E-side end portion of the base plate 64, and serve as electrical contacts which are disposed for contact with contacts of a connector 100.

Hereinafter, the heating resistors 71 to 74 will be referred to as the heating resistor group, the heating resistors 72, 73 (first heating resistor group) will be referred to as the inside heating resistors Rin, and the heating resistors 71, 74 (second heating resistor group) will be referred to as the outside heating resistors Rout. A symbol C0 represents a virtual axis that passes through a predetermined reference position, e.g., an intermediate point, in the lateral direction of the base plate 64.

The inside heating resistors Rin (heating resistors 72, 73) are disposed substantially symmetrically with each other with respect to the virtual axis C0 in the lateral direction of the base plate 64. The outside heating resistors Rout (heating resistors 71, 74) are disposed remoter from the virtual axis C0 than the inside heating resistors Rin and substantially symmetrically with each other with respect to the virtual axis C0 in the lateral direction of the base plate 64.

The heating resistors 72, 73 have the same resistance value and the same resistance distribution as each other. The heating resistors 71, 74 have the same resistance value and the same resistance distribution as each other. The resistance distribution and resistance value of the heating resistors 72, 73 differ from those of the heating resistors 71, 74.

The heating resistors 72, 73 each have a longitudinal intermediate portion which is narrower in width than each of longitudinal opposite end portions. The heating resistors 71, 74 each have a longitudinal intermediate portion which is wider in width than each of longitudinal opposite end portions (FIG. 3A). As a result, in each of the heating resistors 72, 73, the amount of heat generated at the intermediate portion is greater than that generated at each of the opposite end portions. On the other hand, in each of the heating resistors 71, 74, the amount of heat generated at each of the opposite end portions is greater than that generated at the intermediate portion.

Since the inside heating resistors Rin (heating resistors 72, 73) are disposed symmetrically with each other with respect to the virtual axis C0, the heating resistors 72, 73 generate the same amount of heat at symmetrical positions with respect to the virtual axis C0. Similarly, the heating resistors 71, 74 (outside heating resistors Rout) generate the same amount of heat at symmetrical positions with respect to the virtual axis C0.

The F-side end portions of the heating resistors 72, 73 are connected with each other by an electrically conductive part (hereinafter simply referred to as the conductive part) 92 and are in an electrically conductive state with each other. The E-side end portions of the heating resistors 72, 73 are connected to conductive parts 94, 93 whose tip end portions constitute electrical end portions Eb, Ea, respectively.

The F-side end portions of the heating resistors 71, 74 are connected with each other by an electrically conductive part 91, and are in an electrically conductive state with each other. The E-side end portion of the heating resistor 71 is connected to an electrically conductive part 95 whose tip end portion constitutes an electrical end portion Ec. The E-side end portion of the heating resistor 74 is connected to the conductive part 93.

It should be noted that the F-side end portions of the inside heating resistors Rin and the outside heating resistors Rout are not electrically conductive to each other.

The power supply electrodes 81 to 83 are concentratedly disposed on the E-side end portion of the base plate 64. The electrical end portions Ea to Ec of the conductive parts 93 to 95 are respectively connected to the power supply electrodes 81 to 83. In other words, the power supply electrode 83 is an electrode for power supply to the outside heating resistors Rout, and the power supply electrode 82 is an electrode for power supply to the inside heating resistors Rin. The power supply electrode 81 is a common electrode for power supply to the inside heating resistors Rin and to the outside heating resistors Rout. The connector 100 is inserted in a direction of arrow G in FIG. 3A and removed in a direction opposite to the direction of arrow G.

Figure 4:
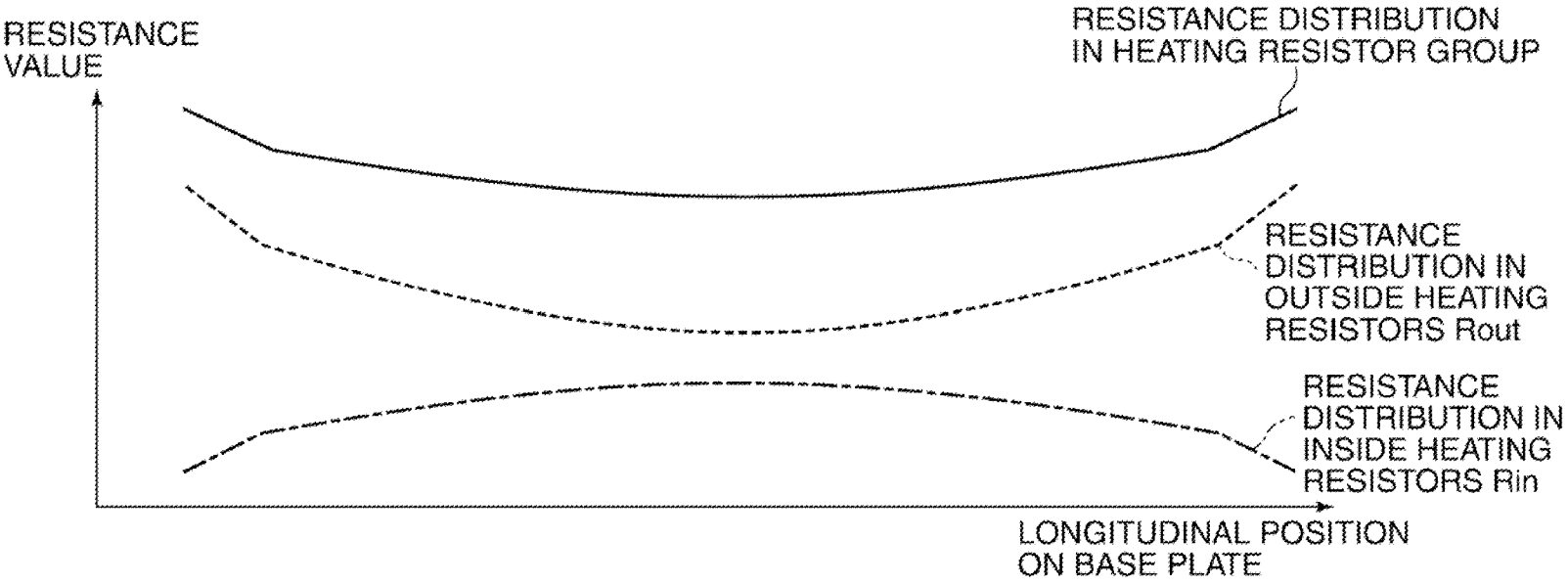
FIG. 4 is a view showing a resistance distribution in heating resistors of the heating member along a longitudinal direction of a base plate of the heating member.

FIG. 4 shows a resistance distribution in the heating resistors of the heating member 61 along the longitudinal direction of the base plate 64.

The heating resistor group is configured to have a total resistance value that is slightly smaller at a longitudinal central portion of the base plate 64 than at each of opposite end portions as shown by a solid line in FIG. 4, whereby a heat distribution becomes substantially uniform in the longitudinal direction of the base plate 64.

The inside heating resistors Rin are configured to have a resistance value that is greater at the central portion of the base plate 64 than at each of the opposite end portions as shown by a one-dotted chain line in FIG. 4, and generate much heat at the central portion of the base plate 64 when supplied with electric power across the electrical end portions Ea, Eb.

The outside heating resistors Rout are configured to have a resistance value that is smaller at the central portion of the base plate 64 and greater at each of the opposite end portions of the base plate 64 as shown by a broken line in FIG. 4, and generate much heat at each end portion of the base plate 64 when supplied with electric power across the electrical end portions Ea, Ec.

Transfer sheets 110 conveyed to the thermal fixing device 60 pass through the base plate 64 of the heating member 61. At that time, each transfer sheet 110 necessarily passes through the longitudinal central portion of the base plate 64.

For this reason, the total resistance value of the inside heating resistors Rin is made smaller than that of the outside heating resistors Rout to make the amount of heat of the heating member 61 greater at the longitudinal central portion than at each of the opposite end portions of the base plate 64, thereby making an electric current flowing through the inside heating resistors Rin greater than an electric current flowing through the outside heating resistors Rout. Furthermore, a ratio between power supply to the outside heating resistors Rout and power supply to the inside heating resistors Rin is controlled according to the width of transfer sheet 110, thereby controlling the heat distribution of the heating member 61 in the longitudinal direction of the base plate 64 according to the width of transfer sheet 110.

Figure 5:
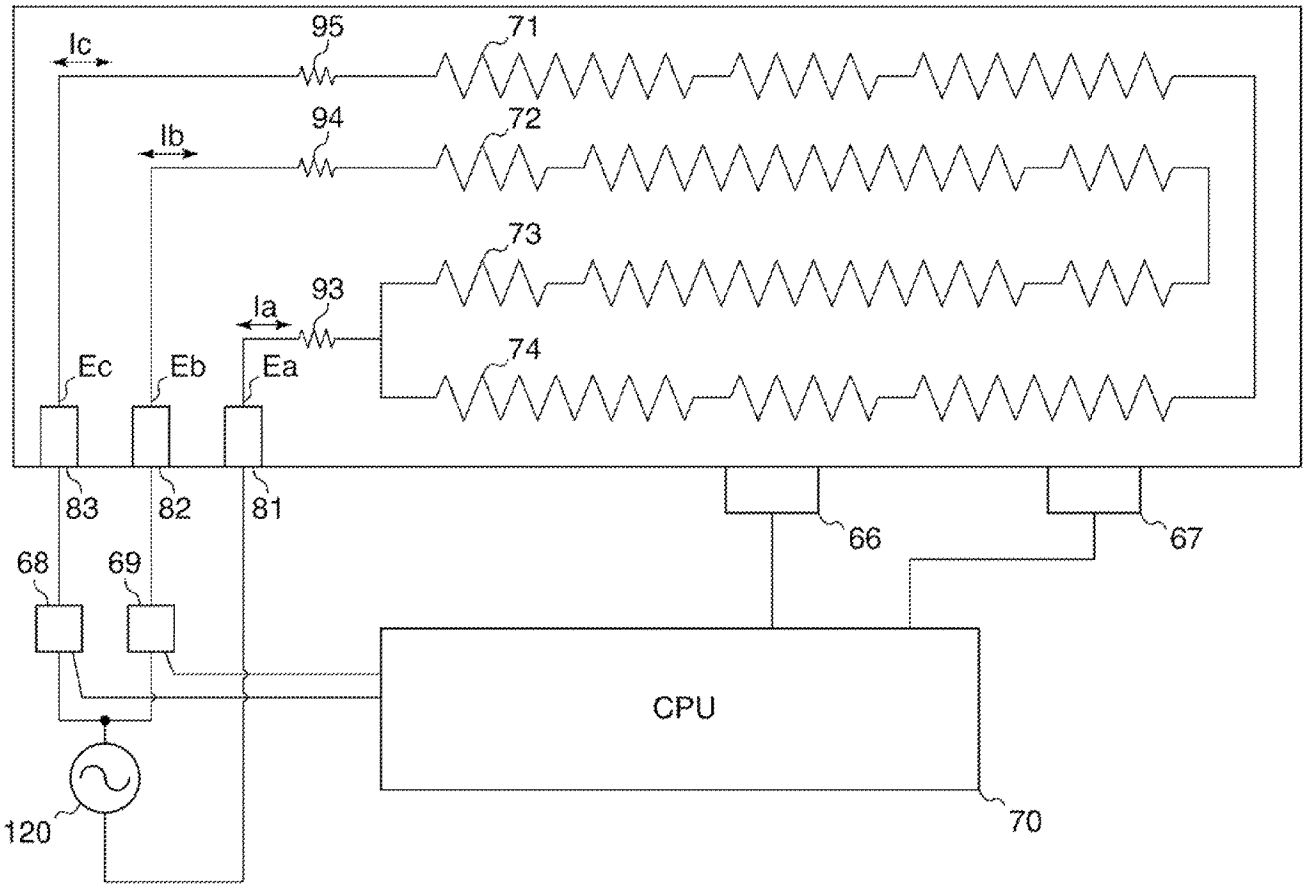
FIG. 5 is a wiring diagram schematically showing an electrical connection relationship between the heating member and its peripheral elements.

FIG. 5 schematically shows in wiring diagram an electrical connection relationship between the heating member 61 and its peripheral elements.

As shown in FIG. 5, the thermistors 66, 67 of the thermal fixing device 60 are respectively disposed on a central portion and one end portion of a longitudinal side face of the heating member 61, and connected to the CPU 70. The thermistors 66, 67 function as temperature sensors. Based on output signals from the thermistors 66, 67, the CPU 70 monitors a temperature of the longitudinal central portion of the heating member 61 and a temperature of the one longitudinal end portion of the heating member 61.

The power supply electrode 81 of the thermal fixing device 60 is connected to a commercial power source 120, and the power supply electrodes 82, 83 are connected via breaker devices 69, 68 to the commercial power source 120. The breaker device 68 controls power supply from the power source 120 to the electrically conductive parts 95, 93 and to the outside heating resistors Rout (heating resistors 71, 74). The breaker device 69 controls power supply from the power source 120 to the electrically conductive parts 94, 93 and to the inside heating resistors Rin (heating resistors 72, 73). These breaker devices 68, 69 are connected to the CPU 70.

The CPU 70 controls the breaker devices 68, 69 based on temperatures of the longitudinal central portion and the one longitudinal end portion of the heating member 61, which are represented by output signals of the thermistors 66 and 67, respectively, thereby controlling the power supply to the conductive parts 95, 93 and to the outside heating resistors Rout (heating resistors 71, 74) and controlling the power supply to the conductive parts 94, 93 and to the inside heating resistors Rin (heating resistor 72, 73).

As described above, the conductive part 93 having the electrical end portion Ea is connected to the heating resistors 73, 74, and the conductive part 94 having the electrical end portion Eb and the conductive part 95 having the electrical end portion Ec are respectively connected to the heating resistors 72, 71.

In FIG. 5, symbols Ia, Ib, Ic respectively denote electric currents flowing through the conductive parts 93, 94, and 95. The electric currents Ia to Ic are mainly decided by resistance values of the heating resistors 71 to 74 since each of the heating resistors 71 to 74 (heating resistor group) has a resistance value greater than that of a corresponding one of the conductive part 93 to 95.

As described above, the electric current flowing through the inside heating resistors Rin (heating resistors 72, 73) are greater than the current flowing through the outside heating resistors Rout (heating resistors 71, 74). More specifically, the electric current Ib flowing through the heating resistor 72 and through the conductive part 94 is larger than the current Ic flowing through the heating resistor 71 and through the conductive part 95. The current Ia flowing through the heating resistors 73, 74 and through the conductive part 93 is represented by the sum of the currents Ib, Ic. In other words, the current Ia is the largest, the current Ib is the next largest, and the current Ic is the smallest. Roughly speaking, the ratio between the currents Ia, Ib, and Ic is 5:3:2.

Power loss in a resistor is represented by the product of square of an electric current flowing through the resistor and a resistance value of the resistor. To minimize power losses in resistors that are disposed within a limited space (base plate width), it is preferable to make power losses in these resistors substantially uniform to one another. In other words, it is preferable to configure the resistors to have resistance values whose ratio is proportional to reciprocals of squares of currents flowing through the resistors.

In this embodiment, the conductive parts 93 to 95 are configured to have resistance values whose ratio becomes e.g. 1:2.78:6.25 in consideration of the ratio of 5:3:2 among the currents Ia, Ib, and Ic flowing through the conductive parts 93 to 95. The conductive parts 93 to 95 and the power supply electrodes 81 to 83 connected thereto are configured such that the resistance values of the conductive parts 93 to 95 become smaller in this order.

More specifically, the power supply electrode 81 is disposed closest to the heating resistor group, and the conductive part 93 is configured to have a largest cross-sectional area in a power supply direction (i.e., a largest conductive width) and to have a shortest length. The power supply electrode 82 is disposed next closest to the heating resistor group, and the conductive part 94 is configured to have a next largest conductive width and to have a next shortest length. The power supply electrode 83 is disposed remotest from the heating resistor group, and the conductive part 95 is configured to have a narrowest conductive width and to have a longest length. In other words, conductive parts that can provide larger amounts of power supply have wider conductive widths.

The electrically conductive parts 93 to 95 are formed to have conductive widths that can substantially achieve the above-described ratio of resistance values. It should be noted that in a case where the conductive parts 93 to 95 are configured to achieve a predetermined ratio of resistance values under constraints about the size of the base plate 64, etc., the conductive widths of the conductive parts 93 to 95 sometimes become excessively narrow. In that case, the conductive parts 93 to 95 can be formed to have conductive widths that are as wide as possible, irrespective of the conductive widths that are determined based on the predetermined ratio of resistance values.

In the thermal fixing device 60, a power supply control process is executed by the CPU 70 when a printing operation is requested.

Figure 6:
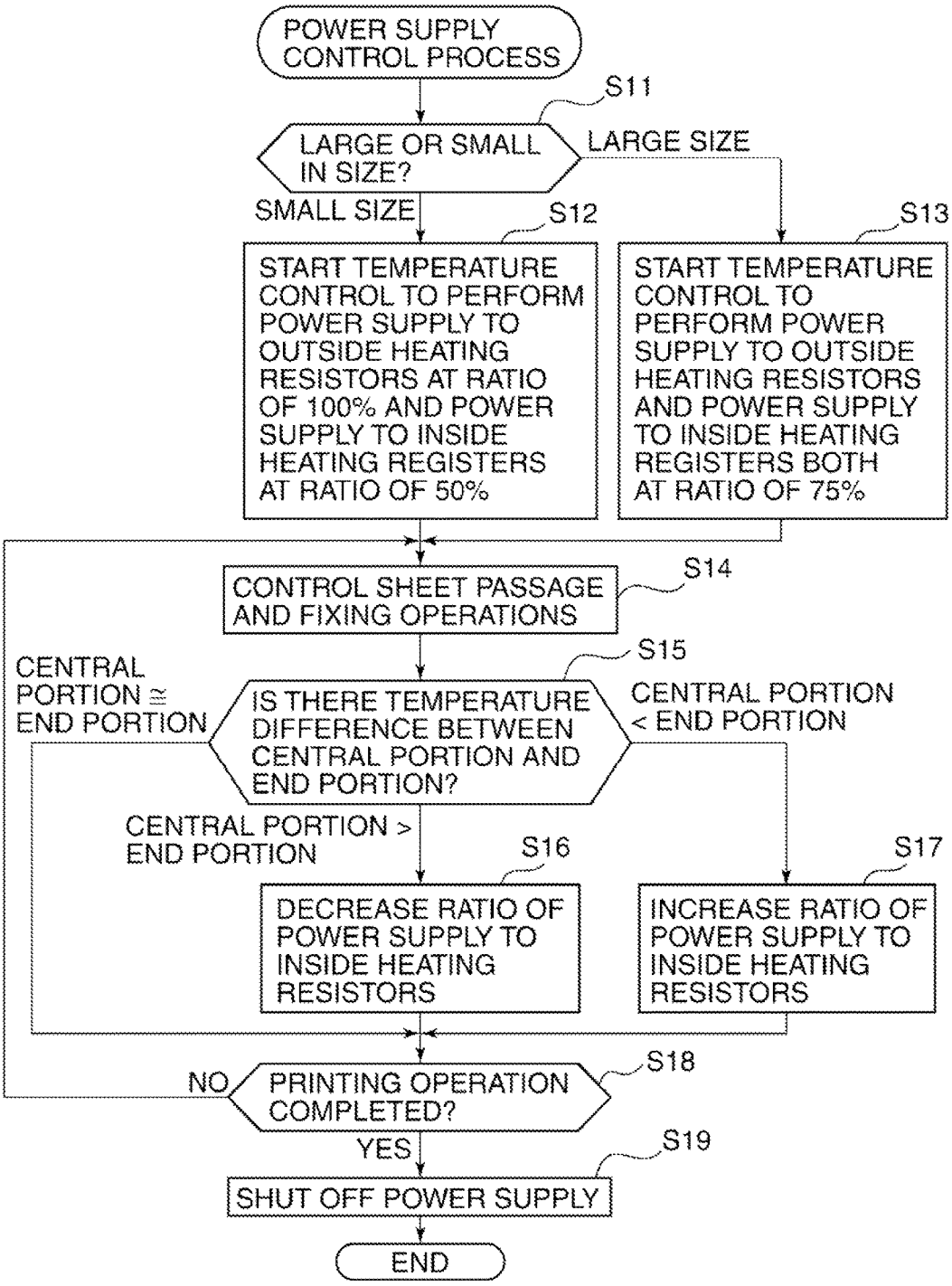
FIG. 6 is a flowchart showing procedures of a power supply control process executed by a CPU of the thermal fixing device.

FIG. 6 shows in flowchart the procedures of the power supply control process executed by the CPU 70 of the thermal fixing device 60.

The power supply control process is started when a request for a printing operation is input to the CPU 70 shown in FIG. 5. The CPU 70 determines whether transfer sheets 110 to be fed to the thermal fixing device 60 are large or small in size based on an output from a corresponding one of the sheet size sensors 41*c* to 44*c*, which are shown in FIG. 1 (step S11). For example, transfer sheets 110 each having a width equal to or larger than 270 mm are determined as being large in size, whereas transfer sheets 110 each having a width less than 270 mm are determined as being small in size.

Next, the CPU 70 starts temperature control to control the breaker devices 68, 69 according to the size of transfer sheets 110. More specifically, if determined in step S11 that transfer sheets 110 are small in size, the CPU 70 controls the breaker devices 68, 69 such that power supply from the commercial power source 120 to the outside heating resistors Rout is performed at a ratio of 100% and power supply to the inside heating resistors Rin is performed at a ratio of 50% (step S12), thereby making it possible to prevent temperatures of the heating member 61 at its opposite end portions where transfer sheets 110 do not pass from excessively increasing.

On the other hand, if determined in step S11 that transfer sheets 110 are large in size and pass through substantially the entire face of the heating member 61, the CPU 70 controls the breaker devices 68, 69 such that power supply to the outside heating resistors Rout and power supply to the inside heating resistors Rin are performed both at a ratio of 75% (step S13), whereby temperature unevenness on the surface of the heating member 61 can be eliminated.

Next, the CPU 70 performs control to cause each transfer sheet 110 to pass through the fixing nip N of the thermal fixing device 60 and to cause a toner image to be heated and fixed to the sheet (step S14). Each time each transfer sheet 110 passes through the heating member 61, the CPU 70 compares outputs of the thermistors 66, 67 to each other, thereby comparing a temperature of a longitudinal central portion of the heating member 61 and a temperature of one longitudinal end portion thereof to each other (step S15).

If determined in step S15 that the temperatures of the central portion and one end portion of the heating member are nearly equal to each other, the CPU 70 holds current ratios of power supply to the outside heating resistors Rout and to the inside heating resistors Rin unchanged, and proceeds to step S18.

If determined in step S15 that the temperature of the central portion of the heating member is higher than the temperature of one end portion thereof, the CPU 70 controls the breaker device 69 such that the ratio of power supply to the inside heating resistors Rin is decreased by a predetermined amount, e.g., about 5% (step S16). As a result, the temperature of the central portion of the heating member decreases relative to the temperature of one end portion of the heating member.

On the other hand, if determined in step S15 that the temperature of one end portion of the heating member is higher than the temperature of the central portion thereof, the CPU 70 controls the breaker device 69 such that the ratio of power supply to the inside heating resistors Rin is increased by a predetermined amount, e.g., about 5% (step S17), whereby the temperature of the central portion of the heating member increases. As a result, the temperature of one end portion of the heating member decreases relative to the temperature of the central portion of the heating member.

Next, the CPU 70 determines whether or not the printing operation is completed (step S18). If determined in step S18 that the printing operation is completed, the CPU 70 controls the breaker devices 68, 69 such that the power supply to the heating resistor group is shut off (step S19), whereupon the power supply control process is completed.

According to the control process of FIG. 6, the power supply to the heating resistors is controlled by utilizing characteristic of resistance distribution, i.e., characteristic of heat distribution in the inside heating resistors Rin and that in the outside heating resistors Rout of the heating member 61 along the longitudinal direction of the base plate. More specifically, the power supply is controlled so as to decrease the ratio of power supply to the inside heating resistors Rin when the temperature of the longitudinal central portion of the heating member 61 is higher than the temperature of one end portion thereof, but to increase the ratio of power supply to the inside heating resistors Rin when the temperature of one end portion of the heating member 61 is higher than that of the longitudinal central portion thereof.

As a result, a temperature difference between the central portion and one end portion of the heating member 61 becomes small, whereby the electrically conductive parts 93 to 95 that electrically connect the power supply electrodes 81 to 83 to the heating resistors 71 to 74 can be suppressed from generating heat. As a result, thermal affections to peripheral members can be prevented. In particular, a temperature rise of the power supply connector 100 can be suppressed to ensure the reliability of the connector 100. Since it becomes unnecessary to use a high-priced material to form metallic parts of the connector 100, increase in cost is not caused.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2012-165866, filed Jul. 26, 2012, which is hereby incorporated by reference herein in its entirety.

What is claimed is:

1. A heating device comprising:

a base plate;

a plurality of heating resistor members disposed in a longitudinal direction of said base plate;

a plurality of power supply electrodes disposed on one longitudinal end portion of said base plate, said plurality of power supply electrodes disposed on the one longitudinal end portion of said base plate including power supply electrodes configured to independently supply electric power to heating resistor members of said plurality of heating resistor members, and also including another power supply electrode connected to said plurality of heating resistor members; and a plurality of electrically conductive parts configured to connect said plurality of heating resistor members and said plurality of power supply electrodes to one another, wherein said plurality of electrically conductive parts are formed such that electrically conductive parts of said plurality of electrically conductive parts that are capable of having larger amounts of current flow therethrough have larger cross-sectional areas thereof with respect to a perpendicular direction to the longitudinal direction of said base plate.

2. The heating device according to claim 1, wherein said plurality of electrically conductive parts are formed such that the electrically conductive parts of said plurality of electrically conductive parts that are capable of having larger amounts of current flow therethrough are shorter in length with respect to the longitudinal direction of said base plate, and said plurality of power supply electrodes are disposed such that power supply electrodes connected to the electrically conductive parts of said plurality of electrically conductive parts that are capable of having larger amounts of current flow therethrough are disposed nearer to said plurality of heating resistor members.

3. The heating device according to claim 1, wherein said plurality of electrically conductive parts have resistance values that are formed such that the electrically conductive parts of said plurality of electrically conductive parts that are capable of having larger amounts of current flow therethrough have smaller resistance values.

4. The heating device according to claim 1, wherein said plurality of electrically conductive parts have resistance values whose ratio is proportional to reciprocals of squares of currents flowing through said plurality of electrically conductive parts.

5. The heating device according to claim 1, wherein said plurality of heating resistor members have a first heating resistor member and a second heating resistor member, said first heating resistor member is comprised of a pair of heating resistors that are disposed substantially symmetrically with each other with respect to a virtual axis passing through a predetermined reference position in a lateral direction of said base plate and that have end portions thereof disposed on a side close to another longitudinal end portion of said base plate and connected to be electrically conductive to each other, said second heating resistor member is comprised of a pair of heating resistors that are disposed remoter from the virtual axis than said first heating resistor member in the lateral direction of said base plate and substantially symmetrically with each other with respect to the virtual axis and that have end portions thereof disposed on the side close to the another longitudinal end portion of said base plate and connected to be electrically conductive to each other, and said first heating resistor member is configured to be electrically non-conductive to said second heating resistor member at the another longitudinal end portion of said base plate.

6. The heating device according to claim 5, wherein an end of said first heating resistor member is connected to a first power supply electrode out of said plurality of power supply electrodes through a first electrically conductive part out of said plurality of electrically conductive parts, an end of said second heating resistor member is connected to a second power supply electrode out of said plurality of power supply electrodes through a second electrically conductive part out of said plurality of electrically conductive parts, and another end of said first heating resistor member and another end of said second heating resistor member are connected to a third power supply electrode out of said plurality of power supply electrode through a third electrically conductive part out of said plurality of electrically conductive parts, and a cross-sectional area of the second electrically conductive part with respect to the perpendicular direction to the longitudinal direction of said base plate is larger than a cross-sectional area of the first electrically conductive part with respect to the perpendicular direction to the longitudinal direction of said base plate and smaller than a cross-sectional area of the third electrically conductive part with respect to the perpendicular direction to the longitudinal direction of said base plate.

7. The heating device according to claim 5, wherein the pair of heating resistors of said first heating resistor member are each configured such that an amount of heat generated at a longitudinal central portion of said base plate becomes greater than an amount of heat generated at each of opposite end portions of said base plate, and the pair of heating resistors of said second heating resistor member are each configured such that an amount of heat generated at the longitudinal central portion of said base plate becomes smaller than an amount of heat generated at each of the opposite end portions of said base plate.

8. The heating device according to claim 5, wherein said first heating resistor member has a resistance value smaller than a resistance value of said second heating resistor member.

9. An image forming apparatus comprising:

an image forming unit configured to form an image; and a thermal fixing device configured to thermally fix the image onto a sheet, the thermal fixing device comprising:

a base plate;

a plurality of heating resistor members disposed in a longitudinal direction of said base plate;

a plurality of power supply electrodes disposed on one longitudinal end portion of said base plate, said plurality of power supply electrodes disposed on the one longitudinal end portion of said base plate including power supply electrodes configured to independently supply electric power to heating resistor members of said plurality of heating resistor members, and also including another power supply electrode connected to said plurality of heating resistor members; and a plurality of electrically conductive parts configured to connect said plurality of heating resistor members and said plurality of power supply electrodes to one another, wherein said plurality of electrically conductive parts are formed such that electrically conductive parts of said plurality of electrically conductive parts that are capable of having larger amounts of current flow therethrough have larger cross-sectional areas thereof with respect to a perpendicular direction of the longitudinal direction of said base plate.

10. A heating device comprising:

a base plate;

a first heating member disposed along a longitudinal direction of said base plate;

a second heating member disposed along the longitudinal direction of said base plate, and having such a resistance value as that a current value flowing through said second heating member is greater than a current value flowing through said first heating member;

a first power supply electrode connected to one end portion of said first heating member so as to supply electric power to said first heating member;

a second power supply electrode connected to one end portion of said second heating member so as to supply electric power to said second heating member independently of said first heating member;

a third power supply electrode connected to the other end portion of said first heating member and the other end portion of said second heating member so as to supply electric power to said first heating member and said second heating member;

a first electrically conductive part connected to between the one end portion of said first heating member and said first power supply electrode;

a second electrically conductive part connected to the one end portion of said second heating member and having a cross-sectional area thereof with respect to a perpendicular direction to the longitudinal direction of said base plate larger than a cross-sectional area of said first electrically conductive part with respect to the perpendicular direction to the longitudinal direction of said base plate; and a third electrically conductive part connected to the other end portion of said first heating member and the other end portion of said second heating member, and having a cross-sectional area thereof with respect to the perpendicular direction to the longitudinal direction of said base plate larger than a cross-sectional area of said second electrically conductive part with respect to the perpendicular direction to the longitudinal direction of said base plate.

11. An image forming apparatus comprising:

an image forming unit configured to form an image; and a thermal fixing device configured to thermally fix the image onto a sheet, the thermal fixing device comprising:

a base plate;

a first heating member disposed along a longitudinal direction of said base plate;

a second heating member disposed along the longitudinal direction of said base plate, and having such a resistance value as that a current value flowing through said second heating member is greater than a current value flowing through said first heating member;

a first power supply electrode connected to one end portion of said first heating member so as to supply electric power to said first heating member;

a second power supply electrode connected to one end portion of said second heating member so as to supply electric power to said second heating member independently of said first heating member;

a third power supply electrode connected to the other end portion of said first heating member and the other end portion of said second heating member so as to supply electric power to said first heating member and said second heating member;

a first electrically conductive part connected to between the one end portion of said first heating member and said first power supply electrode;

a second electrically conductive part connected to the one end portion of said second heating member and having a cross-sectional area thereof with respect to a perpendicular direction to the longitudinal direction of said base plate larger than a cross-sectional area of said first electrically conductive part with respect to the perpendicular direction to the longitudinal direction of said base plate; and a third electrically conductive part connected to the other end portion of said first heating member and the other end portion of said second heating member, and having a cross-sectional area thereof with respect to the perpendicular direction to the longitudinal direction of said base plate larger than a cross-sectional area of said second electrically conductive part with respect to the perpendicular direction to the longitudinal direction of said base plate.

* * * * *